United States Patent [19]

Leemhuis

[11] 4,312,163

[45] Jan. 26, 1982

[54] REINFORCED STRUCTURAL MEMBER AND METHOD OF FABRICATION

[75] Inventor: John C. Leemhuis, Downey, Calif.

[73] Assignee: Aircontrol Systems, Inc., Carolina, P.R.

[21] Appl. No.: 69,874

[22] Filed: Aug. 27, 1979

[51] Int. Cl.[3] ..... E04B 1/16

[52] U.S. Cl. ..... 52/381; 52/612; 52/700; 52/704; 52/713

[58] Field of Search ..... 52/381, 382, 612, 700, 52/704, 410, 713

[56] References Cited

U.S. PATENT DOCUMENTS

| | | | |
|---|---|---|---|
| 1,466,264 | 8/1923 | Ambursen | 52/704 |
| 1,788,481 | 1/1931 | Brostrom | 52/700 |
| 1,887,455 | 11/1932 | Helberg | 52/700 |
| 2,007,689 | 7/1935 | Merrill | 52/381 |
| 2,592,634 | 4/1952 | Wilson | 52/410 |
| 2,602,323 | 7/1952 | Leemhuis | 52/381 |
| 2,772,560 | 12/1956 | Neptune | 52/704 |
| 3,334,458 | 8/1967 | Leemhuis | 52/381 |
| 3,754,066 | 8/1973 | Black | 52/713 |

*Primary Examiner*—Price C. Faw, Jr.
*Assistant Examiner*—Henry E. Raduazo
*Attorney, Agent, or Firm*—Herzig & Walsh Inc.

[57] ABSTRACT

An improved reinforced structural member and method of fabricating the member. The structural member is a truss slab of a type embodying a lower concrete slab having reinforcement embedded therein; means providing a network of passages overlying the base slab; and an overlying concrete slab with reinforcement therein, including concrete columns extending between the overlying slab and the base slab. Additional reinforcing members or struts are provided connected between the reinforcing members in the lower slab and the reinforcing members in the upper slab. These members are of improved construction embodying a lower section and a separable upper section. The lower section extends to the height of the top surface of the lower slab permitting improvements in the method in that the lower slab can be poured without the reinforcing struts or members being in the way. The upper section of the reinforcing strut is then joined to the lower section, after which the upper slab is poured.

3 Claims, 8 Drawing Figures

REINFORCED STRUCTURAL MEMBER AND METHOD OF FABRICATION

BACKGROUND OF THE INVENTION

1. Field of the Invention

The field of the invention is broadly that of construction and construction materials and more especially, it deals with an improved reinforced concrete truss slab, and a method of fabrication.

2. Description of the Prior Art

Relevant prior art is primarily in the U.S. Pat. No. 3,334,458 and the steel forms or pans disclosed in that patent which are the subject of a still earlier U.S. Pat. No. 2,602,323.

U.S. Pat. No. 3,334,458 discloses a structural member which is a reinforced concrete truss slab which embodies a lower reinforced concrete slab and an upper slab with a network of passageways formed by way of steel forms or pans integrated into the structural member. There are columns of concrete extending between the upper reinforced slab and the lower reinforced slab with reinforcing members or struts extending between the reinforcing means in the lower slab and in the upper slab.

With respect to the method or technique of fabricating the structural member of the prior art, the lower slab is first poured with its reinforcing members supported on supports which are known as chairs. The forms or pans are positioned on the lower slab after which the upper slab is poured. When the lower slab is poured, the connecting reinforcing members or struts are in position to be embedded in the columns and in such position they are in the way of the pouring process and thus impede efficient fabrication. Also, this construction is an impedement to ease of screeding after the slab is poured.

The herein invention as described in detail hereinafter is intended to overcome these deficiencies of the prior art and otherwise to realize objectives and provide advantages as described in detail hereinafter.

SUMMARY OF THE INVENTION

The nature of the invention has been briefly outlined in the abstract.

The invention is concerned with a type of structural member as described in the description of the prior art.

The improvement in the structural member resides in the reinforcing members or struts which extend between the reinforcing means in the lower concrete slab and that in the upper slab. In the preferred exemplary form of the invention this reinforcing strut member, which can be referred to as an insert, is formed in sections including a lower section and upper section, which is detachable from the lower section, the sections preferrably being threaded together. The lower section includes a point which can be driven into the wooden plywood slab on which the lower concrete slab is poured. The inserts are positioned on centers corresponding to the positions of the concrete columns between the upper and lower slabs. The lower section is provided with two diameters, forming an angular shoulder which with a washer serves to provide a support for the reinforcing members before the slab is poured, thus eliminating the use of "chairs" to support the reinforcing members.

After completion of fabrication, that is pouring and screeding of the lower slab, the upper sections of the inserts are simply threaded into the lower sections, thus being in position for becoming embedded in the upper slab, the upper sections serving to support the reinforcing material of the upper slab before pouring.

The invention further provides and makes possible improvements, with respect to the screeding after pouring of the lower slab. For this purpose a modified form of insert is provided, having a third section in the form of a straight rod, which after pouring of the lower slab, these third sections can be threaded into the first sections of the insert, these sections being threaded in on 8' centers, for example, to facilitate screeding. An angle bracket, having a part with a hole in it can slip down over the rod and then be set with a wingnut. This bracket forms a holding bracket for a 2'×4' and then a screed can be simply slid along the tops of such 2'×4"s to screed the concrete down to the desired level. After screeding and insertion of the second sections of the reinforcing struts, then the second sections of the modified struts, having a third section are coupled to the third sections and embedded in the upper concrete slab.

In the light of the foregoing, the primary object of the invention is to make available an improved composite reinforced concrete truss member of the type having a lower reinforced concrete slab and an upper reinforced concrete slab, with a network of passageways formed in it and with reinforcing struts extending between the reinforcing means in the lower slab and in the upper slab, wherein the said connecting struts comprise insert means, having a lower section and an upper section, which are separable so that the lower slab can be poured and screeded without interference from the reinforcing struts.

A further object is to make available a reinforcing strut in the form of a multi-part member having a bottom section, which can be supported on a wooden platform on which a concrete slab is poured and which is configurated to support reinforcing material and to which an upper section can be secured after the lower concrete slab has been poured and screeded.

A further object is to realize an improved reinforcing strut member in the form of an insert as described, wherein a third intermediate section is provided adapted for supporting a screed holding bracket to facilitate the screeding of the lower slab of the composite member.

A further object is to realize the advantage of accurate assured placement of the steel in the lower slab, with the assured vertical axis of the inserts.

Further objects and additional advantages of the invention will become apparent from the following detailed description and annexed drawings.

DESCRIPTION OF THE PREFERRED EMBODIMENT OF THE INVENTION AND METHOD OF FABRICATION

The following description includes as well the best mode of practice of the invention.

With respect to the prior U.S. Pat. Nos. 2,602,323 and 3,334,458, these patents and the technology defined in them hereby is incorporated herein by reference.

Figure 1:
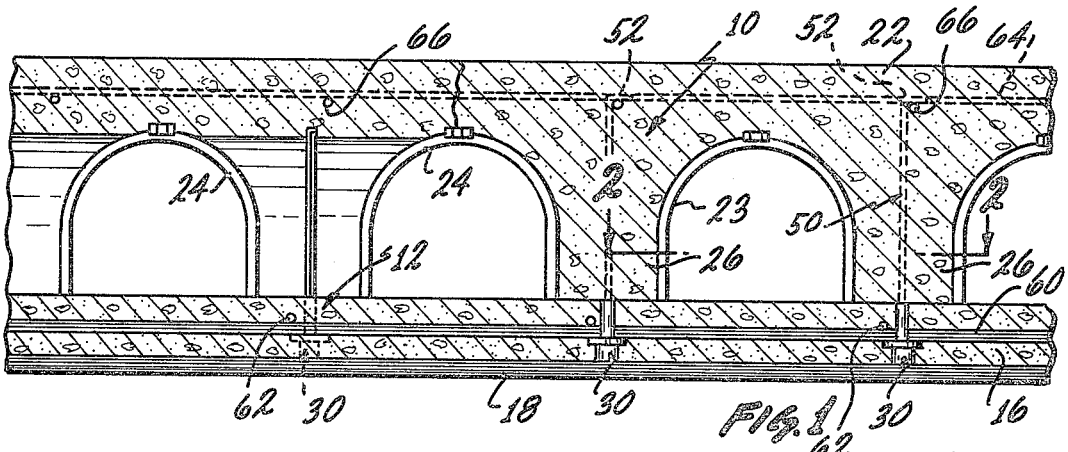
FIG. 1 is a partial cross sectional view of a preferred form of the reinforced structural member of the invention.
Figure 3:
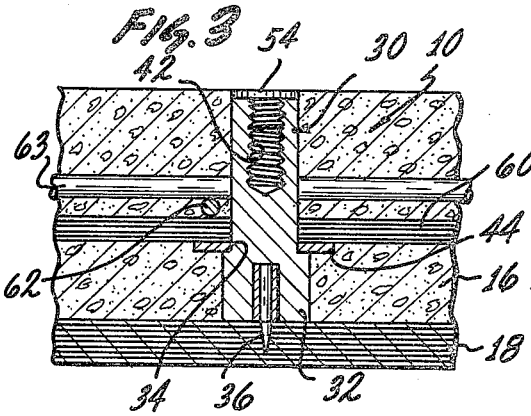
FIG. 3 is an enlarged sectional view of a part of the structural member, illustrating the construction of the lower section of one of the reinforcing inserts.
Figure 2:
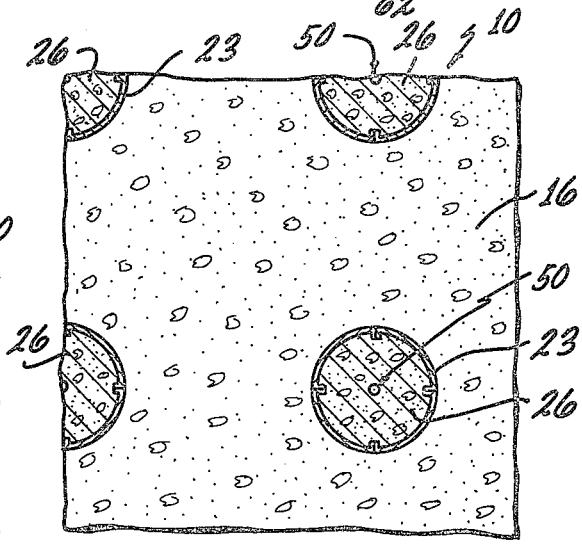
FIG. 2 is a sectional view taken along line 2—2 of FIG. 1.

Referring to the drawings, numeral 10 in FIGS. 1, 2, and 3 designates a preferred form of the improved reinforced structural member.

Figure 4:
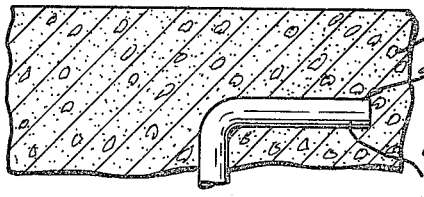
FIG. 4 is an enlarged cross sectional view similiar to that of FIG. 3, further illustrating a complete reinforcing insert strut extending between the lower slab and the upper slab.

Numeral 12 in FIG. 4 designates a preferred form of the improved insert member, that is, the reinforcing strut member that extends between the upper and lower slabs. The structural member of FIGS. 1, 2, and 3 is similar to that shown in FIGS. 9–11 of U.S. Pat. No. 3,334,458. The forms or pans for the structural member preferably would correspond to that shown in FIGS. 6 and 7 of the earlier patent.

The diagonal shear reinforcing members, as shown in the prior patent are replaced in the herein invention by means of the reinforcing members, that is, the inserts as shown in FIG. 4.

In the FIGS., numeral 16 designates a base slab which is poured first, preferrably on a surface made of wood, such as plywood or the like, as designated at 18. The lower slab 16 has reinforcing members embedded in it, as will be described.

The upper concrete slab is designated at 22, the slab overlying the network of forms or pans 23, which as stated correspond to those of the previous patents and which form the interlocking passageways such as designated by the numeral 24. The upper slab forms the columns or pillars 26, which are between adjacent forms and which connect the upper slab and the lower slab.

The reinforcing struts in the form of the inserts 12, are positioned as shown to align with the columns or pillars 26.

Each of the reinforcing struts, as shown in FIG. 4, is in the form of an insert, which includes a bottom section 30. The lower part of this section has a larger diameter, as designated at 32, so as to provide a square shoulder 34. Numeral 36 designates a pointed member which is losely placed into the lower end of the section 30, which can be driven into the wooden platform 18 to support this section of the insert during pouring of the slab.

The section 30 has a threaded bore 42. Numeral 44 designates a washer that can fit down over the upper part of section 30 against the shoulder 34. Numeral 50 designates the second section of the insert 12, which includes a threaded part 51, which comes into a position associated with the reinforcing members embedded in the upper slab 22, as will be described. Numeral 54 designates an end cap, having a threaded stem 55, which can be threaded into the bore 42 in a position as shown in FIG. 2 during pouring of the lower slab, the height of the lower section 30 being such as to be level with the upper surface of the lower slab when poured.

Numerals 62 and 63 designate the reinforcing members that are embedded in the lower slab. Numeral 60 designates reinforcing mesh usually two layers. Numerals 64 and 66 designate the reinforcing members that are embedded in the upper slab. It will be observed that the angular part 52 of the second section 50 insert extends over the reinforcing member 66 shown in FIG. 1. Normally the reinforcing member 66 is fastened to the angular part 52 of the second section 50 to hold it in position before pouring the upper slab.

FABRICATION

The wooden surface, such as plywood 18 as positioned where the lower slab 16 is to be poured. Before pouring, the inserts 12 are positioned on centers, as shown, to be aligned with the concrete columns or pillars 26 formed as part of the upper slab. Before pouring the concrete, the reinforcing member 60 and 62 are supported on the washers 44, as shown in the FIGS. The end caps 54 are in position at the upper ends of the lower sections 30 of the inserts.

Typically, the reinforcing material includes the reinforcing mesh material 60 as well as the member 62 and 63. In the prior art it was customary to support the reinforcing material from the plywood decking by pieces or members, called chairs, made of plastic. When the concrete was poured, these members would become embedded. The spacing of such members would depend upon the thickness and weight of the reinforcing material. In the herein invention, the chairs are eliminated by use of the inserts, as described in the foregoing. The wire mesh screen may have mesh openings four inches on a side, for example and it is supported by the inserts as described, positioned at a corner of the mesh, that is the first layer of mesh. Then the second layer can be laid on top of the first layer, with the intersecting wires at the diametrically opposite part or position of the insert, so that the result is that the insert cannot move around. This can be seen in the upper and lower layers of mesh, positioned and described, to lock the insert members in position, immovably. This technique insures that the inserts will be straight up and down, that is vertical, which is, of course, desirable for purposes of threading in the reinforcing members.

The concrete is then poured for the lower slab. Screeding can be done in a manner known in the prior art, or in a preferred manner as described hereinafter.

It is significant that since the top ends of the lower sections 30 of the inserts are at the same level as the top surface of the lower slab 22, they are not in the way and they are not an impedement to screeding.

After screeding, the caps 54 are removed and the upper sections 50 of the reinforcing struts are then threaded into the bores in the lower sections 30 so that they are in a vertical position with their angular parts 52 in a position as shown in FIGS. 1 and 3 and as previously described.

The upper slab 22 is then poured producing a structural member as shown in the FIGS. with the columns or pillar 26 of concrete formed in between the pans or forms as already described with the reinforcing struts 50 embedded in the columns in a vertical position as shown.

The structural member, as described, has all the features, advantages and characteristics as described in the prior U.S. Pat. No. 3,334,458 in addition to having the improvements as described herein.

Figure 6:
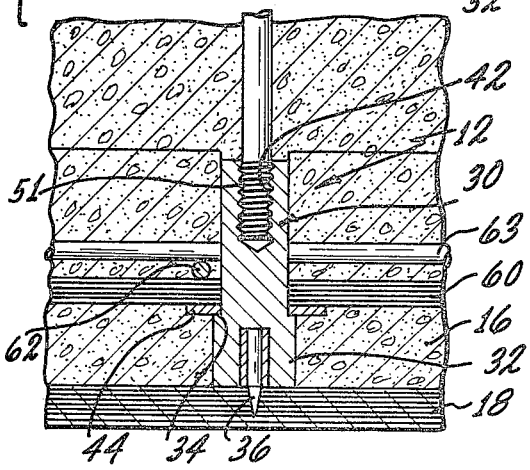
FIG. 6 is a sectional view of a modified form of the bottom section of an insert member which has a threaded bore in the lower end also.
Figure 6:
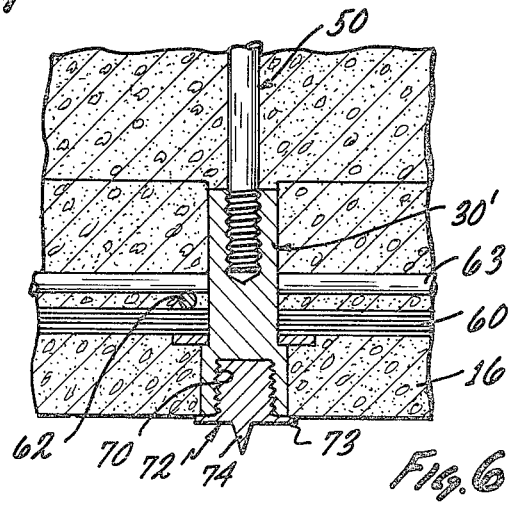
Figure 5:
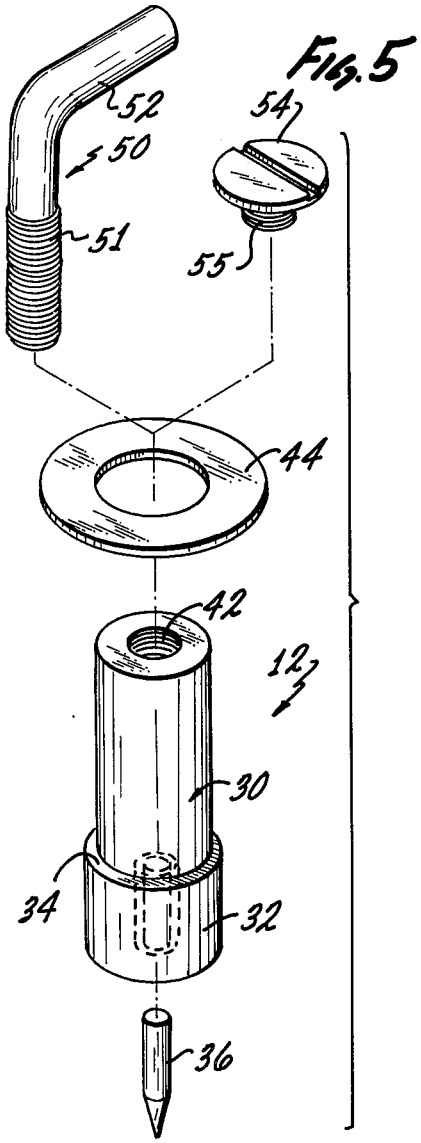
FIG. 5 is an exploded view of a preferred form of insert.

FIG. 6 shows a lower insert section 30' of a modified form of insert. The section 30' has a threaded bore 70 in its lower end. Numeral 72 designates a fitting that can be threaded into the bore 70, the fitting including a flange part 73, having extended point 74, which can be driven into the wooden surface on which the lower slab is poured. When the slab is completed the fitting 72 can be removed and then the threaded bore 70 provides means for supporting light fixtures or otherwise from the ceiling of the structure.

Figure 7:
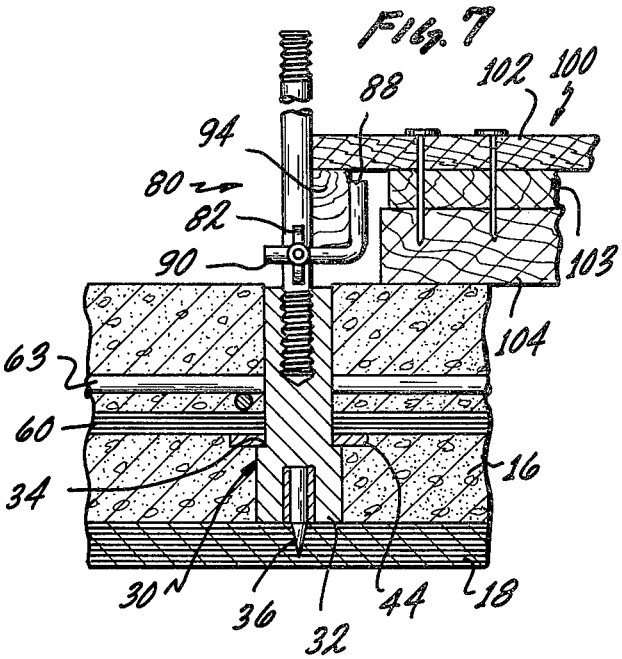
FIG. 7 is a partial sectional view illustrating utilization of the insert to support a screed.

FIG. 7 of the drawing shows utilization of the inserts, they provide capability for facilitating screeding. After pouring the lower slab 16, straight intermediate rods or sections, as shown at 80, are threaded into the lower sections 30 of the inserts on 8' centers to provide it support for brackets, that can support the screeding equipment. FIG. 7 shows such an angle bracket 88, which has a part 90, having a hole in it where it can fit over the section 80 and it can slip down over the section 80 so as to be held by a wingnut 82, as shown. 2'×4"s as designated by 94 can be supported in tow of these brackets, as shown, and then a screed, as shown at 100, can be supported on these 2'×4"s and slid over the lower slab for screeding. The screed includes an upper member 102, having nailed to it the screeding member 104 with a spacer member 103 in between.

After screeding, the sections 80 can be removed and the regular stirrups 50 can be put in position in all of the inserts, as previously described.

Figure 8:
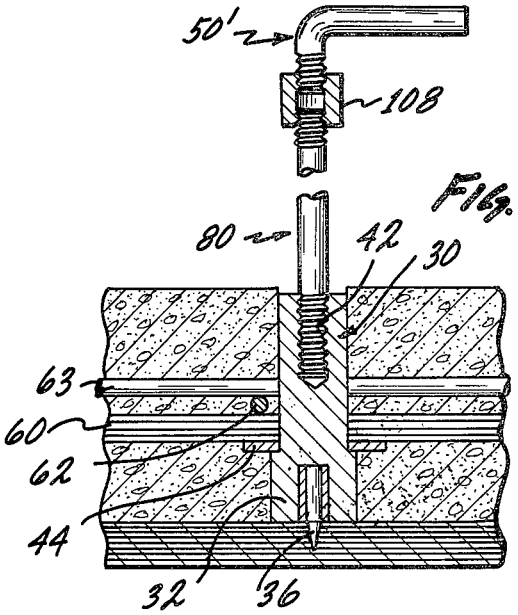
FIG. 8 is a partial sectional view of a modified form of insert formed in three sections.

FIG. 8 shows a slightly modified arrangement, wherein the sections 80 can be left in position after screeding the lower slab. The upper slab is then poured and after pouring, the wet concrete is displaced sufficiently to attach modified reinforcing stirrups as shown at 50' to the sections 80, by way of attachment members or couplings, such as shown at 108.

From the foregoing, those skilled in the art will readily understand the nature of the invention, as well as the manner of construction and fabrication of the slab, as well as the techniques involved. The construction and the techniques of fabrication as described in the foregoing, represents the preferred form of practicing the invention.

The foregoing disclosure is illustrative of the preferred form of the invention and is to be interpreted in an illustrative, rather than a limiting sense, the invention to be accorded the full scope of the claims appended hereto.

What is claimed is:

1. In an improved composite truss member, having a slab of concrete including a horizontal base slab, which has reinforcing means extending through the slab, a web formation comprising spaced form members providing a network of spaces for allowing air circulation through the network overlying the base slab, the slab having an overlying layer of concrete on the web formation and having spaced columns of concrete extending through the web formation to said base slab, the base slab having reinforcing members embedded in the slab, the improvement including the reinforcing members having member portions extending through the said columns, the said member portions being individually separable and including a first section embedded in the base slab, and a second section detachably securable to the first section, whereby the base slab can be poured without the second sections in place, so as to not be in the way during pouring, the said first sections including sockets to detachably receive the second sections, the second sections having upper end parts adapted for securing to reinforcing members embedded in the upper part of the truss member, each of the said sections having a threaded bore at one end adapted to have a part of a second section threaded thereinto, and each of said first sections having a bore, at the other end adapted to be utilized for supporting material from a ceiling of a finished structure.

2. An apparatus as in claim 1, said first sections being provided with means for detachably supporting these on a flat surface member on which the concrete can be poured, said last means including a socket having said last bore in it and means adapted to be received in the bore for penetrating the flat surface member.

3. An apparatus as in claim 1, wherein said last bore is internally threaded.

* * * * *